US005390821A

United States Patent [19]

Markel

[11] Patent Number: 5,390,821

[45] Date of Patent: Feb. 21, 1995

[54] METHOD AND APPARATUS FOR DISPENSING ROLLABLE ARTICLES

[76] Inventor: Stephen M. Markel, 6842 Quail St., Arvada, Colo. 80004

[21] Appl. No.: 192,412

[22] Filed: Feb. 4, 1994

[51] Int. Cl.[6] ..... G07F 11/02

[52] U.S. Cl. ..... 221/194; 221/155; 221/197; 221/287; 221/305; 206/44.12; 206/427

[58] Field of Search ..... 221/155, 186, 191, 194, 221/197, 287, 289, 305; 206/44.12, 427

[56] References Cited

U.S. PATENT DOCUMENTS

| | | | |
|---|---|---|---|
| 1,658,724 | 2/1928 | Kendall . | |
| 1,694,897 | 12/1928 | Washburn . | |
| 1,999,021 | 4/1935 | Marsh . | |
| 2,663,604 | 12/1953 | Davies . | |
| 3,184,104 | 5/1965 | De Domenico et al. . | |
| 3,265,246 | 8/1966 | Messenger . | |
| 3,356,279 | 12/1967 | Root | 221/305 X |
| 3,743,137 | 7/1973 | Bennett | 221/289 |
| 3,776,419 | 12/1973 | Zinkgraf et al. . | |
| 4,194,647 | 3/1980 | Spurrier . | |
| 4,364,509 | 12/1982 | Halley, Jr. et al. | 221/305 |
| 5,228,590 | 7/1993 | Blaska et al. | 206/44.12 X |

*Primary Examiner*—Robert P. Olszewski
*Assistant Examiner*—Dean A. Reichard

[57] ABSTRACT

Method and apparatus are disclosed for dispensing rollable articles from a package, container or the like. The apparatus includes a retainer for placement over an opening in a package to prevent rollable articles contained in the package from rolling en masse out of the package. The retainer also defines a port for controllably dispensing rollable articles from the package. In addition, the apparatus includes a holder for rollingly receiving an article controllably dispensed from the package through the port. The holder is capable of holding the dispensed articles to enable an individual to remove an article from the holder by grasping it. In addition, an attachment means is provided which cooperates with the retainer for securing the retainer to the package over the package's opening.

20 Claims, 1 Drawing Sheet

METHOD AND APPARATUS FOR DISPENSING ROLLABLE ARTICLES

TECHNICAL FIELD OF THE INVENTION

The present invention relates generally to the dispensing of rollable articles from the packages in which they are stored. More particularly, this invention relates to a dispenser which may be slid over such a package containing a plurality of containers to dispense individual articles directly from the package.

BACKGROUND OF THE INVENTION

The art is replete with dispensing structures and devices for dispensing goods and beverages in canned containers. Many of these structures and devices are particularly adapted to dispense the goods or beverage containers one-at-a-time such that when one container is removed from the dispensing apparatus by an individual, another container is automatically dispensed within the apparatus for removal therefrom. Most of these devices are particularly suited not only to dispense the canned goods or beverages, but also to display them for the promotion of sales. As such, they are primarily used in public places such as convenience stores, commercial building lunch rooms, self-service retail stores, subway platforms, etc. A few of such devices are suited for the personal dispensing of containers, specifically of beverage containers, as will be described herein. In almost all of these devices the individual goods or beverages containers must first be manually loaded into the devices one-by one by hand. Only after the individual containers have been hand loaded into the dispensing structure will the one-at-a-time dispensing of the containers begin. Accordingly, the user is actually forced to go through a procedure wherein the goods or beverage containers are first manually removed from the package in which a plurality of the containers are stored and sold, and then manually inserted into the apparatus from which the containers are to be individually dispensed. Having to perform both procedures is not only time consuming but is also inconvenient. Furthermore, in many of these devices loading the goods containers into the apparatus poses the risk of damaging the containers, or requires inconvenient and potentially injurious action on the part of the individual performing the loading to prevent such damage.

U.S. Pat. No. 1,999,021 to Marsh discloses an ephemeral multi-channel display and dispensing apparatus primarily to be used in merchandising several types of contained products simultaneously. The apparatus is folded and assembled from a number of blanks of packaging material, such as corrugated cardboard. Marsh discusses the problem of having to single load individual containers into the apparatus, and solves the problem by utilizing a specialized loading cartridge containing a plurality of beverage containers which can be inserted into an individual dispensing channel of the apparatus. While Marsh's device is suited for its intended purpose, it requires individual containers to be stored in a non-standard packaging cartridge specifically designed and adapted for use with the devices. If the specialized cartridge is not used, the individual containers, once again, have to be manually loaded one-a-time into each dispensing channel in an inconvenient manner.

U.S. Pat. No. 1,658,724 to Kendall also discloses a device for dispensing and displaying one or more individual containers in self-service stores. The Kendall device focuses primarily on dispensing the containers in a longitudinal orientation wherein the containers are stacked end to end rather than side by side in order to minimize potential injury to an individual removing a dispensed individual container from the device. While the Kendall devices seems well suited to its particular objectives, it also requires the containers to be dispensed by the device to be first individually manually loaded therein. It would also seem that the risk of damaging the individual containers during loading is reduced but not eliminated, in the Kendall device, since the containers are dropped into the device from the top of a track and slide down the track into the dispensing portion of the device.

U.S. Pat. No. 4,194,647 to Spurrier is interesting in that the device is suited for personal use rather than public use. The device disclosed in Spurrier is a cooler chest which resembles a conventional portable cooler but contains additional structure including a can dispenser assembly so that individual containers loaded into a container body within the cooler chest may be individually dispensed from a side of the chest through the can dispenser assembly. Thus, the lid of the cooler may remain closed during dispensing to conserve the cool air within the cooler. While well suited for its particular purpose, the Spurrier device is of limited utility to an individual user in that the containers must be stored inside the cooler chest for the device to be used. Thus, the device cannot be used where the bulky chest will not conveniently fit, such as in a refrigerator. Again, the individual containers must be first be individually loaded from the packaging within which they are sold into the container body inside the cooler chest.

Other patents found in a search for subject matter related to the present invention are as follows:

U.S. Pat. No. 3,184,104 to De Domenico, et al.,
U.S. Pat. No. 1,694,897 to Washburn,
U.S. Pat. No. 2,663,604 to Davies,
U.S. Pat. No. 3,265,246 to Messenger,
U.S. Pat. No. 3,776,419 to Zinkgraf, et al.

In view of the above, it is apparent that while some devices have been developed to dispense individual containers for single container dispensing, a need exists for a device which is easy to manufacture and convenient to use which does not require tedious loading of the containers, particularly beverage containers, from the package within which they are sold into the apparatus. Such a device, if capable of cooperating with the standardized packaging within which a plurality of individual containers are almost universally stored and sold, would enable one to beneficially utilize the preloading of the containers into the standardized packaging. Such a device would thus alleviate the need to individually remove the containers from their packages and re-load them into the dispensing device. Such a device would require less material in its construction because it would not require a storage area for the containers within the device itself. Such a system would also beneficially provide for single container dispensing without worry of injury to the hand of the person removing the individual container from the dispenser or damage to the individual containers during loading of the containers into the device. Such a device would enable private individuals, particularly, to have a convenient means to individually dispense goods or beverage containers directly from the package in which they were sold to the individual. As such, the device would further serve as an excellent promotional item for beverage manufacturers and distributors to give or sell to both retail and wholesale customers to use in cooperation with the standardized 12-pack and 24-pack packaging used by the manufactures within which the individual containers are sold and stored.

DISCLOSURE OF THE INVENTION

The present invention addresses the aforementioned concerns by providing method and apparatus for controllably dispensing rollable articles such as cylindrically shaped beverage containers, golf balls, etc. from a container, package or the like.

In its broadest sense, the apparatus of the invention includes a retainer or retainer means for placement over an opening in a package to prevent rollable articles contained in the package from rolling en masse out of the package. The retainer also defines a port for controllably dispensing rollable articles from the package. The apparatus also includes an article holder or holding means cooperating with the retainer for rollingly receiving an article(s) dispensed from the package through the retainer's port. The holder also holds the dispensed article(s), i.e. after rollingly receiving it, to enable an individual to remove an article from the holder by grasping it. Finally, the apparatus includes attachment means cooperating with the retainer for securing the retainer to the package over its opening.

In a preferred embodiment, the apparatus controllably dispenses generally cylindrically-shaped containers, preferably beverage containers, from a widely-used generally rectangularly-shaped package having a top, a bottom, opposed first and second sides, and left and right ends. The package is of the type for containing a plurality of the containers stored side by side in the package with the bottoms of the containers located against one side of the package and the tops, or lids, of the containers located against the opposed other side of the package. The package is of a standard configuration commonly sold on the retail and wholesale markets in which twelve (12-pack) or twenty-four (case) individual containers, particularly beverage containers, are contained within. The package is further of the type wherein at least one end of the package is capable of being at least partially opened so that the containers can be removed from, or exit, the package. The end is at least partially opened by opening a pair of side extending end flaps which are capable of being folded back against the sides of the package from which they extend. The flaps partially enclose the end when folded over the end.

The dispenser preferably includes three elements. 1. A retainer or retainer means for placement over an opened end of the package and portions of the opposed sides of the package adjacent the open end. Container dispensing holding means are also included which cooperate with the retainer means to rollingly receive a container dispensed from the received open end of the package. The dispensing holding means holds the dispensed container in the holder to enable an individual to remove the container from the dispensing holding means by grasping the container with a hand. Attachment means are also provided which cooperate with the retainer means to secure the retainer means to the package so that it remains secured when at least one of the cylindrically-shaped containers stored in the package is dispensed into the dispensing holding means. In this manner, the beverage containers are prevented from rolling en masse out of the received end of the package.

In a preferred embodiment, the retainer means includes a top, a front and two opposed sides which partially enclose the top and opposing sides of the package adjacent to the received open end of the package. When the end is so received, the associated side end flaps of the package are folded back by the retainer means towards the side from which they extend. The front and opposed sides of the retainer means also define an port which is preferably sized and configured to pass one container out of the package at a time into the beverage container dispensing holder.

The dispensing holder generally includes a pair of forward extensions, each extending forwardly from one of the sides of the retaining means, a retaining strip interconnecting the two forward extensions along their front portions, and a retaining bottom interconnecting the two forward extensions along their bottom portions. When an individual container enters the dispensing holder, it is vertically supported by the retaining bottom and thereby prevent from falling downwardly. The front retaining strip prevents the beverage container from rolling horizontally out of and away from the dispensing holder.

In accordance with an important aspect of this invention, the attachment means include a plurality of flap engaging means extending from the inner surfaces of the sides of the retaining means such that they are capable of engaging the associated side of the end flaps of the package when the flaps are received and held folded back towards the side from which they extend by the retainer means. The flap engaging means are selectively located on the sides of the retainer means to engage the free end of each of the side end flaps. In this manner, the side end flaps themselves are beneficially utilized to retain the apparatus to the package. Preferably, at least two flap engaging means are provided on each of the retainer means' sides to securely attach the apparatus to the package.

Cut out portions, or windows, may also be provided in the front of the retainer means to allow an individual to view the interior of the package and determine generally the number of containers remaining in the package, and to realize a cost and weight savings in the manufacture of the device.

The present invention also provides a method which enables an individual to dispense generally uniformly sized and rollable articles from a container, package or the like. The method comprises the steps of providing a package containing uniformly sized and rollable articles wherein the package has an opening through which the articles may pass. In addition, the method includes the step of providing an apparatus for controllably dispensing rollable articles from the package. The apparatus includes a retainer means, holding means and attachment means as previously described. The method further includes placing the retainer means of the apparatus over the package's opening and then securing the apparatus to the package with its attachment means. Finally, the package with said apparatus secured thereto is placed on a generally horizontal surface so that an article in the package is capable of rolling out through the retainer's port into the holding means of the apparatus.

In a preferred embodiment the method further includes opening the package containing the uniformly sized rollable articles. The container is preferably opened by unfolding a pair of side extending end flaps back against the sides from which the end flaps extend. The retainer means of the apparatus is placed over the opened end of the package and secured to the opened end flaps.

From the foregoing, it will be appreciated by those of ordinary skill in the art of container dispensing devices, that the present invention provides a simple and efficient dispenser which can be used with standardized container packaging, particularly 12-pack and case packaging, to individually dispense the containers directly from the packaging. It will also be appreciated that because the apparatus utilizes the packaging itself, to house the containers, the apparatus may be constructed from a minimal amount of material. It will also be appreciated that the apparatus alleviates the need to remove the individual containers from their packaging and re-load them into the apparatus. It will further be appreciated that the apparatus dispenses the individual containers with little or no harm to the containers or to the individual user of the apparatus.

BRIEF DESCRIPTION OF DRAWINGS

The invention will be more readily understood by reference to the accompanying drawings wherein like reference numerals indicate like elements throughout the drawing figures, and in which.

DETAILED DESCRIPTION OF PREFERRED EMBODIMENTS

Figure 1:
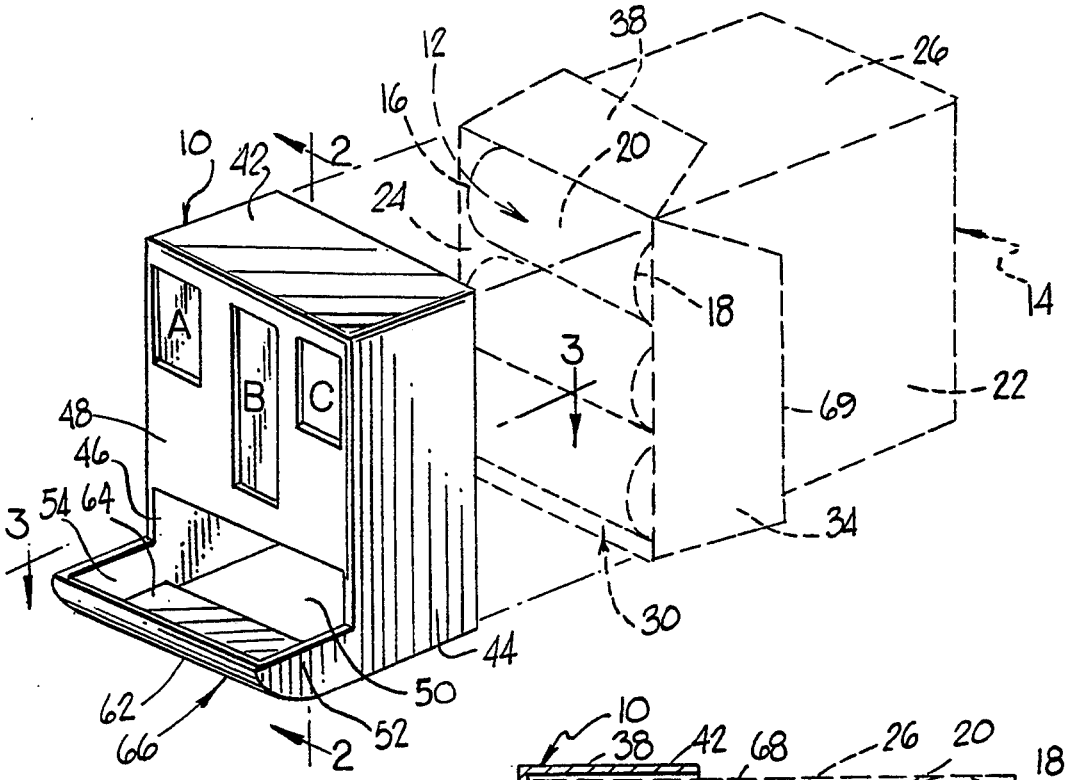
FIG. 1 is a perspective view of a beverage container dispensing apparatus of the present invention for use with a rectangularly-shaped package having side extending end flaps.

FIG. 1 illustrates a beverage container dispensing apparatus, or dispenser 10 of the present invention for dispensing beverage containers 12 from a generally rectangularly-shaped package 14. The beverage containers 12 have a lid or top portion 16, a bottom portion 18, and a side portion 20 which is generally cylindrically-shaped and joins the lid 16 and bottom 18 portions of the container 12. Modern containers 12 are typically formed from lightweight aluminum and typically come in twelve ounce and sixteen ounce sizes.

The generally rectangularly-shaped package 14 contains a plurality of the containers 12 and is typically formed of cardboard material. The package 14 includes a first side 22 and an opposed second side 24, a top 26, a bottom 28, and opposed left 30 and right 32 ends. The beverage containers 12 are generally sold and stored side by side within the package 14 with the container's bottom portions 18 abutting the first side 22 of the package and the container's lid portion 16 abutting the second side 24 of the package. Typically, a dozen (12-pack) or two dozen (case) beverage containers 12 are contained within the package 14. As will be appreciated, the containers 12 are prevented from rolling out of the package 14 by the top 26, bottom 28, and left 30 and right 32 ends of the package.

At least one of the ends 30, 32 are typically closed by a pair of side extending flaps 34, 36 and a top flap 38 (and bottom flap not shown but identical to top flap 38) which extend from the corresponding portions of the container 14, i.e. the top flap 38 extends from the top 26 of the package, the side flap 34 extends from the first side 22 of the package, etc. For this specification, end 30 is illustrated as the end of the package 14 received by dispenser 10. The flaps 34–38, as shown in the drawings, when folded overlap each other and partially close end 30 of the package 14. End 30 is fully closed when the bottom flap (not shown) extending from the bottom 28 of the package 14 is folded to overlap the other flaps 34–38. To open end 30, flaps 34–40 are folded back towards and against their respective portions of the package from which they extend. When package 14 is opened at end 30, the beverage containers 12 are free to roll out of the package through end 30. For the purposes of clarity, in FIGS. 1–3, the beverage containers 12 and the generally rectangular-shaped package 14 are shown in dotted line. In FIG. 1, the package 14 is shown separated from beverage container dispensing apparatus 10.

Once package 14 is opened at end 30 (or 32) by opening flaps 34–40 and folding the flaps back against the sides from which they extend, the package is ready to be received by the beverage container dispensing apparatus 10. Typically, package 14 will be opened in a vertical orientation, i.e. with one end 32 oriented below the open end 30 so that the beverage containers 12 are prevented from falling out of the package 14. The beverage container dispenser 10 is then slid over the open package 14 and the dispenser/package combination is placed in a horizontal position for use.

Dispenser 10 is provided with a retainer means or retainer (not numbered) for receiving and enclosing a portion of the top 26 and sides 22, 24 of the package 14 adjacent the received open end 30 when the dispenser 10 is slid over the package 14. The retaining means or retainer portion of the apparatus includes a top wall 42, opposed side walls 44, 46 and a front wall 48. The walls are formed in a box-like arrangement, with the exception that the retainer portion has an open bottom (not numbered) and an open back (not numbered) which permits the dispenser to receive the container package. As shown, the top wall 42 holds the top flap 38 of package 14 folded back against top 26 when the package 14 is received by the dispenser 10. Similarly, side extending flaps 34 and 36 are respectively held folded back against sides 22, 24 of package 14 from which they extend by the first 44 and second 46 opposed side walls of apparatus 10. The side walls 44, 46 are preferably dimensioned to a height approximately equal to the height of the package 14 such that top 26 of the package 14 generally abuts the inner surface of top wall 42. The top wall 42 and front wall 48 are preferably dimensioned to a width approximately equal to the width of the package 14 such that the sides 22, 24 of the package 14 generally abut the inner surfaces of the first and second side walls 44, 46. Thus, the retainer portion of dispenser 10 has a height and width which is similar to the height and width of the package 14.

Figure 2:
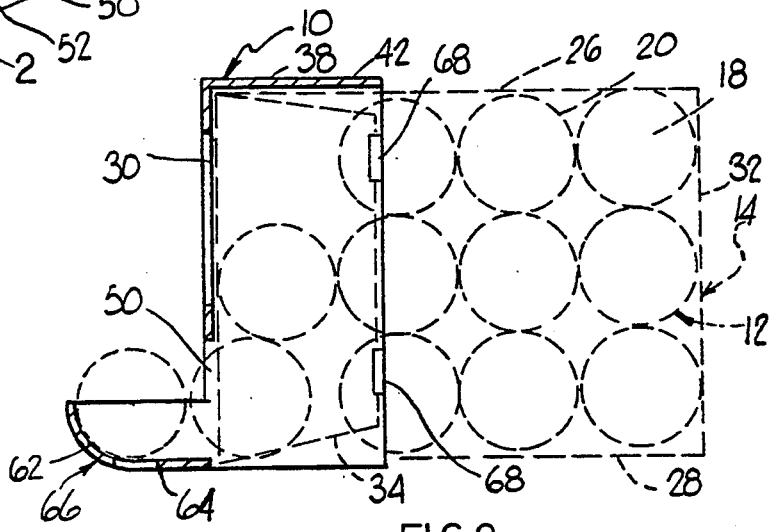
FIG. 2 is a cross-sectional view taken along the lines 2—2 of FIG. 1 showing the apparatus secured to the package and a dispensed beverage container in the dispensing holder of the apparatus.

As also illustrated, the dispenser's front wall 48 adjoins the top wall 42 and the first and second side walls 44, 46 such that, when received by the retainer means, the received end 30 of the package 14 abuts its inner surface. As best shown in FIG. 2, containers in the first column of containers 12, immediately adjacent to the inner surface of the front wall 48, are retained by front wall 48. Dispenser 10 may be of several depths, i.e. several widths of side walls 44, 46 and top wall 42, but, is preferably dimensioned so that approximately one-third of the package 14 is received and enclosed the dispenser. As best shown in FIG. 1, the top edge of front wall 48 abuts the front edge of top wall 42, and the opposed sides of front wall 48 abut the front edges of side walls 44, 46 with the length of front wall 48 being less than the height of the side walls so as to define a port 50 through which a beverage container 12 exiting the package 14 can pass. The height of the port is preferably about 5 to 10% greater than the beverage container 12's diameter to facilitate a container's passage through the port.

In use, the dispenser/package combination will be typically in a generally horizontal position as on a shelf on a refrigerator (not shown). In this orientation, it will be appreciated that the bottom flap of package 14 will be held back against the package's bottom portion 28 by the weight of the beverage containers 12 within the package 14. Therefore, while the dispenser may include a bottom wall, such is not necessary. Similarly, while top wall 42 is provided, it also is not necessary as the apparatus 10 can function without it.

Returning to the figures, it will be appreciated that dispenser 10 is also provided with a beverage container holder or holding means 66, which includes a pair of forward extensions 52, 54, a retaining strip 62 and a retaining bottom 64. As best seen in FIGS. 1 and 2, the first and the second forward extensions 52, 54 extend forwardly from the first and second side walls 44, 46 respectively, extending outwardly from the dispenser's front wall 48, a distance which is preferably equal to the diameter of a single beverage container 12 so that an individual may remove a container from the holder.

Figure 3:
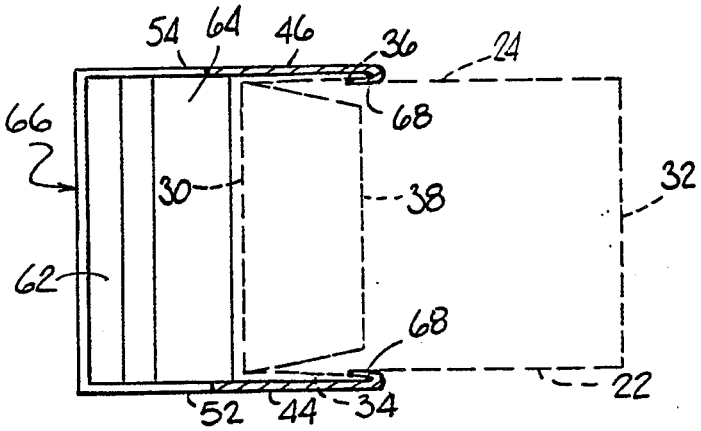
FIG. 3 is a cross-sectional view taken along the lines 3—3 of FIG. 1 showing the cooperation between the flap engagement means and the side extending end flaps.

The retaining strip 62, as best shown in FIG. 1 and FIG. 3, interconnects the first and second forward extensions 52, 54 at their forward portions (not numbered) and has a height which is sufficient to prevent a beverage container 12 from rolling out of the holder. A height of 10–20% of the container's diameter has been found to be sufficient to prevent such rolling. As also illustrated, the retaining strip 62 is preferably shaped to match the contour of a dispensed container received in the holder 66.

The holder's bottom 64 which interconnects the first and second forward extensions 52, 54 should also have a width which prevents a dispensed beverage container 12 from falling through the holder.

As shown in FIG. 2, when an opened package 14 is received by the dispenser 10, and placed into a horizontal orientation, gravity will force a beverage container 12 out of package 14 through port 50 and into dispensing holder 66. The dispensed beverage container 12 may then be removed by an individual from the dispensing holder 66 by grasping the container 12 with the individual's hand. Once the individual has removed a beverage container 12 from the dispensing holder 66, another beverage container 12 will be dispensed from the package 14 and into the dispensing holder 66. In such a manner, the remaining beverage containers 12 in the package 14 will be dispensed one by one from the package every time a beverage container 12 is retrieved from the dispensing holder 66. When only a single row of beverage containers 12 remain in the package 14, however, depending upon the exact orientation of the package dispenser combination on the shelf upon which it rests relative to the horizontal plane, the dispenser/-package combination may have to be tipped slightly forward for the last few beverage containers 12 to roll into the dispensing holder 66.

Figure 4:
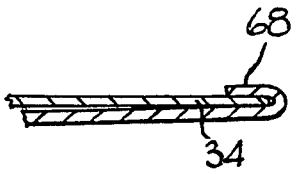
FIG. 4 is a detailed view of flap engagement means of the beverage container dispensing apparatus of the present invention.

In accordance with an important aspect of the present invention, flap engagement means, or catches 68 are provided to secure the dispenser 10 to the package 14 and prevent the dispenser from disengaging or separating therefrom. As shown in FIGS. 2–4, catches 68 extend from the inner surface of each side wall 44, 46 to define a forwardly facing gap between the flap engagement means 68 and the inner surface of each side wall 44, 46. The side flaps 34, 36, which are respectively folded back towards the sides 22, 24 by the receiver, each have free ends 69. In that position, the free ends 69 of the side flaps 34, 36 are rearwardly facing. The catches 68 are located on the side walls 44, 46, so that the free ends 69 of the side flaps 34, 36 are capable of being engaged in the forward facing gaps defined by the flap catches. Any forward force on the dispenser 10, such as the by the impingement of a dispensed container against the retaining strip 62 of the dispensing holder 66, is thereby countered by the engagement of the free ends against the flap catches. Two flap catches are provided on each side 44, 46 of the receiver; one to engage the lower portion of the free end 69 of a flap and one to engage the flap's upper portion. This prevents the dispenser 10 from tipping when a container is dispensed, and otherwise adequately secures it to the package. Flap catches 68, or the equivalents thereof, are, as illustrated, preferably an integral part of the dispenser 10.

As will be appreciated, flap catches 68 cooperate with the package's side flaps 34, 36 to secure the dispenser 10 to the package 14 and prevent the containers from rolling "en masse" out of the open end 30 of the package. "En masse" as defined herein refers to the simultaneous dispensing of many containers from the package which can occur due to gravity when a package of this sort is opened.

The dispenser 10 of the illustrated embodiment is shown, as best seen in FIG. 2, with side walls 44, 46 dimensioned to a length approximately equal the length of each side flap. As such, to be capable of receiving this package's side flaps, the flap catches 68 are located at the rear edge of side walls 44, 46. However, it will be appreciated that the flap catches may be located inwardly from the rear edge if the side walls 44, 46 are longer than the side flaps 34, 36.

FIG. 1 illustrates that the front wall 48 of the dispenser 10 has several cut out portions or windows A, B and C. These windows serve the dual purpose of reducing the amount of material necessary to manufacture dispenser 10, and hence reduce its cost and weight. They also provide view ports for an individual to see into the package 14 to determine the number of remaining beverage containers 12. Windows A and C further provide a convenient gripping surface through which an individual can extend his fingers to carry the dispenser 10.

In view of the above, those skilled in the relevant art will appreciate that the present invention is capable of being expressed in many embodiments, all of which are capable of receiving an opened end of a package, securing the package to the apparatus such that a beverage container dispensed from the package is received in a dispensing holder of the apparatus, and allowing an individual to easily retrieve a container from the dispensing holder.

Thus, it will be appreciated that the present invention provides a novel method of dispensing beverage containers 12 from a package 14. The method includes opening a package 14 at one end 30 by opening the side end flaps 34, 36 and folding the side flaps back towards the sides from which they extend. The dispenser 10 is then slid over the open end 30 of the package 14 so that the side flaps remain folded back against the package's sides. The dispenser 10 is then secured to the package 14 by engaging the free ends 69 of the side flaps 34, 36 with the flap catches 68. This arrangement enables a single beverage container 12 to roll into the holder 66 of the dispenser 10 when the package is positioned horizontally on a surface. It also prevents the remaining containers in the package 14 from rolling out of the package en masse. The single dispensed beverage container (or desired number held in holder 66) may then be retrieved from the holder 66.

The foregoing detailed description of the invention has been made with reference to preferred embodiments thereof. From this description, one skilled in the art can easily ascertain the essential characteristics of this invention, and without departing from the spirit or scope thereof make various changes and modifications to adapt for various usages and conditions. For example, flap catches 68 could be replaced by an elastic strap(s) 55 extending from one side of the dispenser to its other side which would secure the dispenser to the package and prevent the weight of containers in the package from causing the dispenser to separate from the package.

I claim:

1. An apparatus for controllably dispensing rollable articles from a package, container or the like, said apparatus comprising:

retainer means for placement over an opening in a package to prevent rollable articles contained in the package from rolling en masse out of the package, said retaining means also defining a port through which rollable articles are dispensed from the package;

holding means cooperating with said retainer means for rollingly receiving a predetermined number of articles dispensed from the package through said port and permitting access to received articles so that an individual may retrieve an article from the holding means by grasping it; and attachment means for securing said retainer means to the package.

2. An apparatus for controllably dispensing rollable articles as claimed in claim 1 wherein said port defined by said retainer means is sized and configured so that only one rollable article is capable of being dispensed through the port at a time.

3. An apparatus as claimed in claim 1 wherein the rollable articles are beverage containers of the type having a lid, a bottom, and a generally cylindrically shaped side joining the container's lid and bottom and wherein the package is a generally rectangularly shaped package of the type having opposed first and second sides, a top, a bottom and left and right ends, the package being of the type for containing a plurality of said containers which are stored side-by-side in the package wherein the container bottoms are located against the first side of the package and the container lids are located against the oppositely facing second side of the package.

4. An apparatus, as claimed in claim 3, wherein:

said retainer means includes a front, and two opposed sides spaced by said front, such that when the package is covered by said retainer means, the covered open end of the package abuts said front of said retainer means and said sides of said retainer means partially respectively enclose the opposed sides of the package; and wherein the height of said front of said retainer means is less than the height of said sides of said retainer means in an amount greater than the diameter of the generally cylindrically-shaped side of a container to define said port through which a dispensed container may roll out of the package and into said holding means.

5. An apparatus, as claimed in claim 4, wherein the package is further of the type wherein the package's received open end is capable of being at least partially opened by opening a pair of associated side extending end flaps which extend from the package's sides and which are capable of at least partially enclosing the end when they are folded over the end, said side extending end flaps also capable of being folded back towards the package's sides, and wherein:

said retainer means is capable of holding said side end flaps folded back towards the package's sides from which the side end flaps respectively extend when the package's opened end is received by said retainer means; and said attachment means includes end flap engagement means cooperating with said retainer means for engaging said side flaps to secure said retainer means to the package.

6. An apparatus, as claimed in claim 5, wherein each of said side end flaps terminate in a free end, and wherein:

said end flap engagement means engage the free ends of the side extending end flaps so that a forward force on said apparatus is countered by the end flaps.

7. An apparatus, as claimed in claim 5, wherein:

said flap engagement means extend from each of said sides of said retainer means, each of which defines a gap for engaging the free end of a side extending flap of the package.

8. An apparatus, as claimed in claim 4, wherein said holding means comprises:

first and second forward extensions forwardly extending, respectively, from said sides of said retainer means, each of said extensions having a front and a bottom portion;

a retaining strip interconnecting said front portions of said forward extensions; and a retaining bottom interconnecting said bottom portions of said forward extensions.

9. An apparatus, as claimed in claim 4, wherein:

said front of said retainer means includes at least one cut out portion through which the interior of the package may be viewed.

10. An apparatus as claimed in claim 1 wherein said retainer means has opposite sides and wherein said attachment means includes a strap having one end attached to one side of said retainer means and another end attached to the other side of said retainer means, said strap further being provided with a length which enables it to be placed around the package in a relatively tight fitting manner to secure said retainer means to the package over its opening.

11. An apparatus for dispensing beverage containers from a generally rectangularly-shaped package of the type having opposed first and second sides, a top, a bottom, and left and right ends wherein the containers are of the type having a lid, a bottom, and a generally cylindrically-shaped side joining the container's lid and bottom, and the package is of the type wherein the containers are stored side-by-side in the package with the container bottoms located against the first side of the package and the container lids located against the oppositely facing second side of the package such that the package's top, bottom and left and right ends bound the containers by their cylindrical sides to prevent the containers from rolling out of the package, the package further being of the type wherein at least one of the package's right and left ends is capable of being at least partially opened by opening a pair of associated side extending end flaps which extend from the packages's sides and which are capable of at least partially enclosing the end when they are closed over the end, the side extending end flaps also capable of being folded back against the package's sides, said apparatus comprising:

retainer means for receiving at least a partially opened right or left end of the package and the associated opened side extending end flaps for said end so that when said end and its associated end flaps are received by said retainer means, said associated end flaps are folded back against the package's sides;

end flap engaging means cooperating with said retainer means for engaging said associated side extending end flaps when they are received by said retainer means to secure said retainer means to the package so that the cylindrically-shaped containers stored in the package are prevented from rolling en masse out of the received end of the package; and beverage container dispensing holding means cooperating with said retainer means for rollingly receiving a beverage container from the package and for holding the container received in said holding means to enable an individual to remove the container from said dispensing holding means by grasping the container with a hand.

12. An apparatus, as claimed in claim 11, wherein:

said retainer means includes a front and two opposed sides spaced by said front, such that when the package is received by said retainer means, the received open end of the package abuts said front of said retainer means and said sides of said retainer means partially respectively enclose the opposed sides of the package; and wherein the height of said front of said retainer means is less than the height of said sides of said retainer means in an amount greater than the diameter of the generally cylindrically-shaped side of a beverage container to define a port through which a dispensed beverage container may roll out of the package and into said beverage container dispensing holding means.

13. An apparatus, as claimed in claim 11, wherein each of the side end flaps terminate in a free end, and wherein:

said end flap engagement means engage the free ends of the side extending end flaps so that a forward force on said apparatus is countered by the end flaps.

14. An apparatus, as claimed in claim 12, wherein each of said side end flaps terminate in a free end, and wherein:

said flap engagement means extend from the inner surfaces of each of said sides of said retainer means at an acute angle to define a gap therebetween, said flap engagement means located on each said inner surface to allow said free end of said side extending flap respective to said inner surface to be nestled in said gaps.

15. An apparatus, as claimed in claim 12, wherein said beverage container dispensing holding means comprises:

first and second forward extensions forwardly extending, respectively from said sides of said retainer means, each of said extensions having a front and a bottom portion;

a retaining strip interconnecting said front portions of said forward extensions; and a retaining bottom interconnecting said bottom portions of said forward extensions.

16. A method for dispensing generally uniformly sized and rollable articles from a container, package or the like, said method comprising the steps of:

providing a package containing uniformly sized and rollable articles wherein the package has an opening through which the articles may pass;

providing an apparatus for controllably dispensing rollable articles from the package which includes:

retainer means for placement over the opening in an package to prevent rollable articles contained in the package from rolling en masse out of the package, said retaining means also defining a port for controllably dispensing rollable articles from the package;

holding means cooperating with said retainer means for rollingly receiving a predetermined number of articles controllably dispensed from the package through said port, said holding means also being capable of holding the dispensed article(s) to enable an individual to remove an article from the holding means by grasping it; and attachment means cooperating with said retainer means for securing said retainer means to the package over its opening;

placing the retainer means of the apparatus over the opening of the package;

securing the apparatus to the package with its attachment means; and placing the package with said apparatus secured thereto on a generally horizontal surface so that an article in the package is capable of rolling out of the package through the port into the holding means of the apparatus.

17. A method, as claimed in claim 16, further comprising the step of:

removing an individual article from the holding means by grasping it with a hand.

18. A method, as claimed in claim 16, wherein the articles are beverage containers.

19. A method, as claimed in claim 16, wherein the package's opening is created by unfolding a pair of side extending end flaps provided on the package and the attachment means of the apparatus includes end flap engagement means, and wherein the apparatus is secured to the package by engaging the end flaps of the package to the end flap engaging means, said method further comprising the step of:

folding back the side extending end flaps towards the sides from which they respectively extend after opening an end of the package and before placing the apparatus over the package.

20. A method, as claimed in claim 19, wherein the containers are beverage containers.

* * * * *